US005730805A

United States Patent [19]

Bertsch et al.

[11] Patent Number: 5,730,805

[45] Date of Patent: Mar. 24, 1998

[54] DISHWASHER FILTER BACK-WASH SYSTEM INDEPENDENT FROM LOWER WASH ARM

[75] Inventors: Roger J. Bertsch, Stevensville, Mich.; Edward L. Thies, Tipp City, Ohio

[73] Assignee: Whirlpool Corporation, Benton Harbor, Mich.

[21] Appl. No.: 694,220

[22] Filed: Aug. 8, 1996

[51] Int. Cl.[6] ..... B08B 3/02

[52] U.S. Cl. ..... 134/10; 134/104.1; 134/111; 134/176; 134/179; 210/409

[58] Field of Search ..... 134/10, 104.1, 134/104.4, 109, 111, 176, 179; 239/251, 261; 210/355, 409, 412, 433.1

[56] References Cited

U.S. PATENT DOCUMENTS

| | | | |
|---|---|---|---|
| 2,608,981 | 9/1952 | Jackson | 134/176 |
| 2,704,082 | 3/1955 | Jackson | 134/111 |
| 3,491,780 | 1/1970 | Kaldenberg | 134/111 |
| 3,810,480 | 5/1974 | Smith et al. | 134/104.1 |
| 3,989,054 | 11/1976 | Mercer | 134/104.1 |
| 4,038,103 | 7/1977 | Grunewald | 134/176 |
| 4,559,959 | 12/1985 | Meyers | 134/109 |
| 4,972,861 | 11/1990 | Milocco et al. | 134/111 |
| 5,320,120 | 6/1994 | Hoffman et al. | 134/111 |
| 5,333,631 | 8/1994 | Kirkland et al. | 134/179 |
| 5,477,874 | 12/1995 | Yura et al. | 134/176 |
| 5,601,660 | 2/1997 | Jeon et al. | 134/104.4 |
| 5,609,172 | 3/1997 | Chang et al. | 134/104.1 |

FOREIGN PATENT DOCUMENTS

| | | | |
|---|---|---|---|
| 1113489 | 8/1962 | Germany | 134/104.4 |
| 1428358 | 11/1968 | Germany | 134/104.1 |
| 3723721 | 5/1988 | Germany . | |
| 555271 | 8/1943 | United Kingdom | 210/409 |
| 1385706 | 2/1975 | United Kingdom | 210/409 |

*Primary Examiner*—Frankie L. Stinson
*Attorney, Agent, or Firm*—Hill, Steadman & Simpson

[57] ABSTRACT

A soil separator and water distributor for a dishwasher having an annular screen facing into the dish compartment for screening wash water, and a rotating flush arm above the annular screen for flushing soil from an underside of the screen, and a separate wash water arm above the flush arm for spraying the dishes. The wash water arm can thus be flow separated from the flush water arm. Thus, the wash water arm can be operated intermittently while the flush water arm can be operated continuously.

18 Claims, 3 Drawing Sheets

DISHWASHER FILTER BACK-WASH SYSTEM INDEPENDENT FROM LOWER WASH ARM

BACKGROUND OF THE INVENTION

The present invention relates to a washing apparatus, particularly to a dishwashing apparatus. The invention relates to a filter backwashing or "flushing" device for a soil separation unit for a dishwasher.

In known dishwashers such as disclosed in U.S. Pat. No. 5,165,433, a dishwasher soil separator is provided within a dish compartment which recirculates soil laden wash water from the dish compartment, filters soil from a stream of the soil laden wash water through an annular filter screen, and returns the stream of wash water to the dish compartment. The soil separator also pumps recycled wash water to a rotating lower wash arm at a bottom of the dish compartment and also to a rotating upper wash arm at a top of the dish compartment. Water to the upper wash arm can be delivered by a pipe on a side of the dish compartment such as described in U.S. Pat. No. 5,165,433 or vertically within the dish compartment via a short separate pipe carried by the lower rack and able to be positioned in registry with an outlet of the soil separator.

The lower wash arm includes upwardly directed apertures for directing water toward the dishes, and downwardly directed apertures for spraying through a top surface of the filter screen to dislodge soil from an undersurface of the filter screen to prevent clogging thereof.

To provide rotating upper or lower wash arms, apertures for spraying water are directed tangentially to a circle of rotation of the wash arms.

SUMMARY OF THE INVENTION

It is an object of the present invention to provide a filter screen flushing mechanism which is independent of the lower wash arm. It is an object of the invention to provide a filter screen flushing mechanism which can be rotated at a predetermined speed optimized for its task of flushing the filter screen of soil. It is an object of the invention to provide a dual arm soil separator assembly having independently rotatable arms which is relatively free of water leakage around its rotary junctures.

It is another object of the invention to provide an independent filter screen flushing mechanism so that an alternating lower/upper wash arm spray operation or zone spray operation can be achieved without effecting the continuousness of spraying from the filter screen flushing mechanism.

The objects are inventively achieved in that a flush arm having downwardly directed spray apertures is arranged to rotate above a filter screen in a recycle wash water dishwasher. The filter screen is arranged to filter soil from a stream of soil laden water and is arranged in the form of an annular screen coaxial with the flush arm at a bottom of the dish compartment. Above the flush arm is arranged a lower wash arm with apertures directed upwardly for directing wash water toward dishes in the dish compartment. The flush arm and lower wash arm are mounted for independent rotation on an upstanding distribution pipe which receives recycled wash water from a wash water pump within the soil separator. The flush arm and lower wash arm are rotated by reaction force of the water sprayed through the apertures of the arms, the apertures being directed somewhat tangentially with respect to a circle of rotation of the flush and lower wash water arms.

The flush and lower wash water arms are sealed to the distributor pipe by seal rings having a shaped cross section including a triangular extension in cross section and a notch removed from the ring. Water pressure acts on the seal ring to open the ring against an inside surface of the flush and lower wash arms.

The use of a separate flush arm allows the flush arm to be rotated independently of the lower wash arm. The flush arm can thus be selected to rotate at a slower or faster speed than the lower wash arm; can rotate in an opposite or same direction as the lower wash arm; or can be operated continuously while the lower wash arm is used discontinuously.

In an alternating or zone wash arrangement, the upper and lower wash arms can be selectively or alternately operated without effecting the continuous operation of the flush water arm because the flush water arm can be flow separated from the lower wash arm with proper water channeling.

DETAILED DESCRIPTION OF THE PREFERRED EMBODIMENTS

Figure 1:
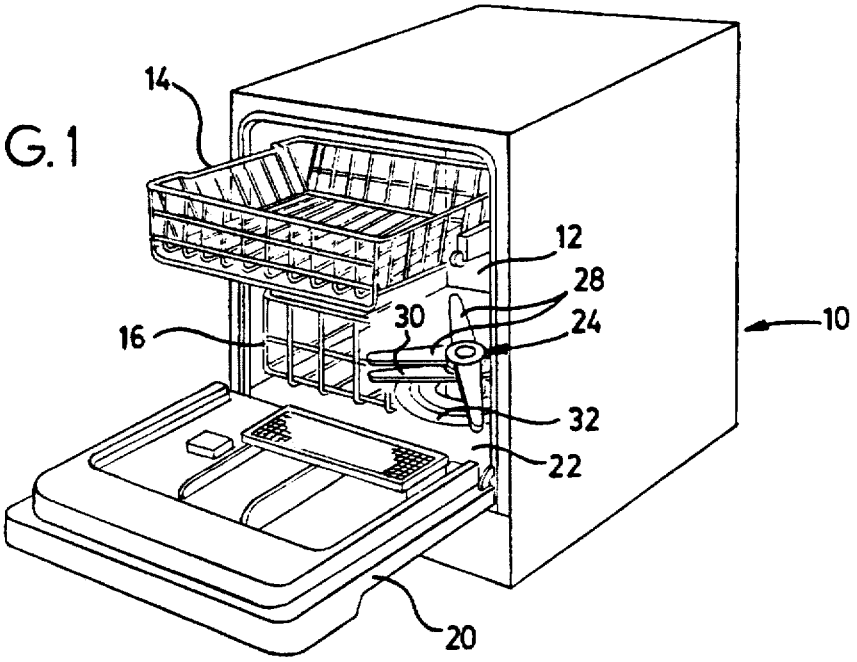
FIG. 1 is a perspective view of a dishwasher according to the present invention.

FIG. 1 illustrates a dishwasher 10 having a dish compartment 12 with racks 14, 16 and a closable door 20. The compartment 12 has a floor 22. In a center region of the floor 22 is a soil separator 24 upon which is mounted a plurality of lower wash arms 28 and a plurality of flush water arms 30. The separator 24 has a water intake grill 32 for receiving water from the compartment 12.

Figure 2:
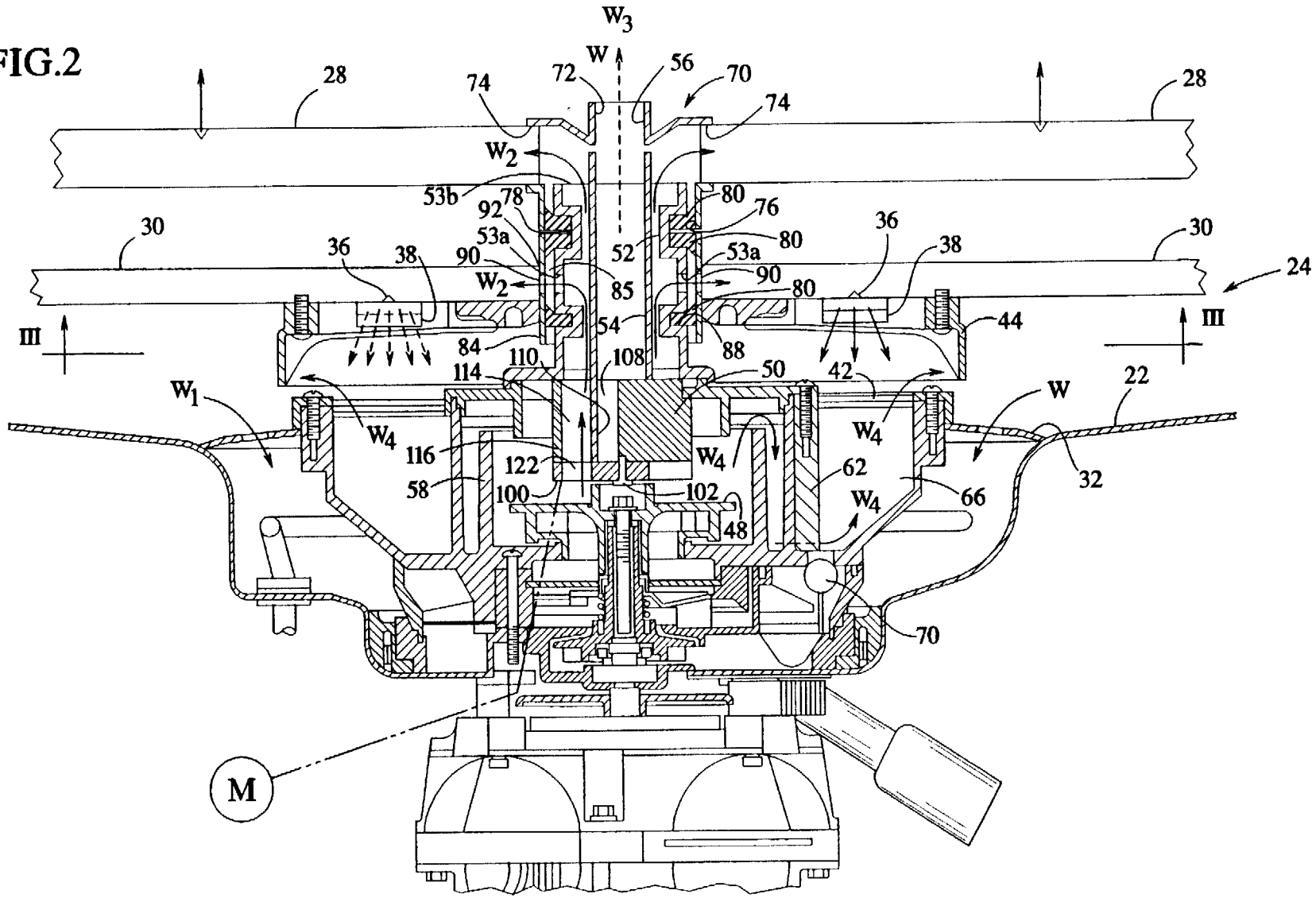
FIG. 2 is a partial sectional view of a soil separator unit as shown in FIG. 1.
Figure 3:
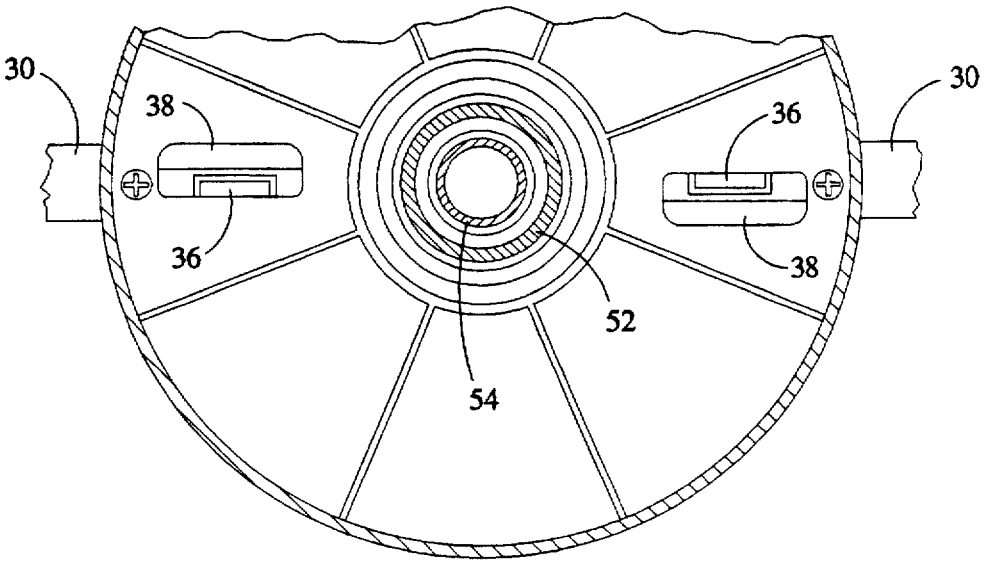
FIG. 3 is a partial sectional view taken generally along line III—III of FIG. 2.

FIG. 2 illustrates two flush arms 30 (although any number, such as four, can be used) as being tubular and having rectangular orifices 36 which are overlain by deflectors 38 arranged to be impacted by a high velocity spray from the orifices 36 and which deflect the spray downwardly and tangentially to impart a rotation to the flush arm 30, as well as direct the spray downwardly against an annular screen 42. The orifices and deflectors are described for example in U.S. Pat. No. 5,165,433. A disk shaped guard 44 is connected to the flush arms, arranged to rotate with the flush arms. The guard 44 protects the screen 42 from damage from falling objects, such as tableware.

Wash water $W_1$ from within the compartment 12 is recycled through the grill 32 and is pumped by a wash water pump 48 to three places. A first portion $W_2$ is pumped through a distributor 50 to a distributor pipe 52 and to the flush arms 30 and the lower arms 28 through orifices 53*a* and pipe opening 53*b* respectively. A second portion $W_3$ is pumped through the distributor 50 to a conduit 54 to a discharge 56 to upper wash arms (not shown). A third portion $W_4$ is pumped over an annular soil concentrator wall 58, through an orifice (not shown) through an outer annular wall 62, to a soil accumulator channel 66. The screen 42 covers the accumulator channel. Water passes from the accumulator channel 66 upwardly through the screen 42 to re-enter the dish compartment 12. Soil is retained in the accumulator channel and is periodically removed through a check valve 70 and sent to drainage.

U.S. Pat. No. 5,165,433 more completely describes this type of soil separator for a dishwasher and is incorporated by reference. The lower wash arms 28 are connected by a cylindrical hub 70 having a top opening 72 and side openings 74 for holding the lower wash arms 28. The hub 70 has an open bottom 76. The open bottom 76 fits over the distributor pipe 52. The distributor pipe has an annular recess 78 adjacent the bottom 76. A seal ring 80 is arranged around and within the recess 78. The seal ring fits tightly within the hub 70 adjacent the open bottom 76. The hub 70 and the arms 28 are free to rotate with respect to the distributor pipe 52 on the ring 80. The ring 80 is more completely described in FIGS. 4, 5, and 5A.

The flush arms 30 are connected to a holding sleeve 84 which is sized to provide an annular space 85 around the distribution pipe 52. Two seal rings 80 are arranged at top and bottom positions of the sleeve 84, between the sleeve 84 and the distribution pipe 52. The top one of the rings 80 fits into the recess 78 and the bottom one of the rings 80 fits into a second recess 88 formed into the distribution pipe 52. The sleeve provides openings 90 in flow communication between the annular space 85, in registry with connected open ends 92 of the flush arms 30. The sleeve 84 and flush arms 30 rotate about the seal rings 80 while receiving water from the annular space 85.

By providing separate lower wash arms 28 and flush arm 30, the lower wash arms can be rotated at a different preselected speed than the flush arms; or can be rotated in an opposite or same direction as the flush arms; or as explained below, can be operated intermittently while the flush arms are operated continuously (or the reverse).

For a zone washing arrangement having the alternate water delivery to the upper and lower wash arms, a rotatable distributor cover 100 is applied onto the distributor 50 by for example a pin 102. The cover 100 is moved by a driver such as schematically shown as M to assume alternate flow-open and flow-closed positions for the lower wash arm and upper wash arm as explained in FIGS. 6 and 7. An apparatus and method for zone washing using alternate water delivery is disclosed in pending patent application U.S. Ser. No. filed Oct. 17, 1995, incorporated herein by reference. (This application is identified by Whirlpool docket number PA-7512, entitled "A Dishwasher Having A Wash Liquid Recirculation System", filed as a provisional application on Oct. 17, 1995, naming Edward L. Thies, Roger J. Bertsch and Wilber Jarvis as inventors.) Although two coaxial channels 52 and 54 are used to feed 1) upper wash arms and 2) lower wash arms and flush arms; the second service can be further divided by a third coaxial channel so that the flush arms can be divorced from the lower wash arms in a water flow sense.

Figure 4:
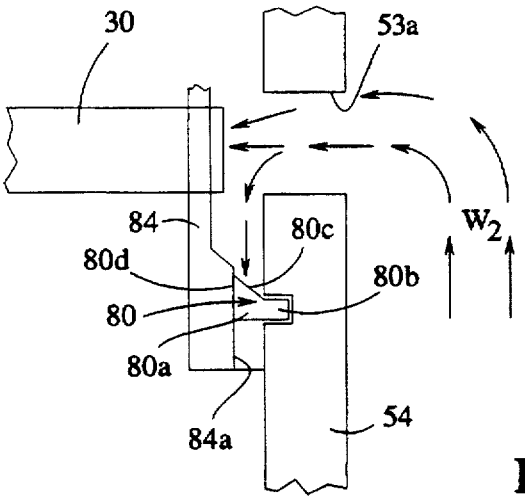
FIG. 4 is an enlarged schematic sectional view of a hub and seal ring assembly.

FIG. 4 describes in more detail the seal ring 80 of the present disclosure. The seal ring 80 provides in cross section a triangular portion 80*a* and a tabular portion 80*b*. A slanted surface 80*c* is provided facing the pressure exerted by the delivered water $W_2$. Force exerted by the water on this surface 80*c* would tend to press the seal 80 on an outside surface 80*d* against an inside surface 84*a* of the sleeve 84.

Figure 5A:
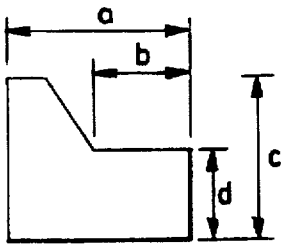
FIG. 5A is a sectional view taken generally along line VA—VA of FIG. 5.
Figure 5:
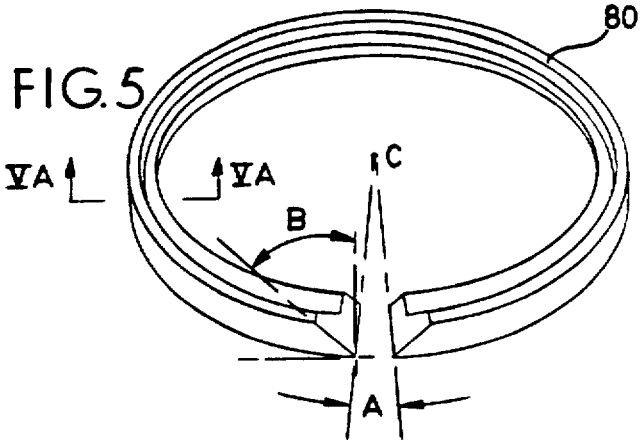
FIG. 5 is a perspective view of the seal ring shown in FIG. 4.

FIG. 5 illustrates the ring 80 having a center point C and having a slot of angle A, approximately 15°, removed from the ring 80. The ring 80 may be made of bronze, lubricated plastic or other material. The unique shape causes pressure from the flowing water to be exerted on the seal to cause it to expand with force proportional to the pressure of the water. Any soil that becomes trapped is ejected at the slot in the ring as the arm turns. The slot is also cut back an angle B from the vertical.

FIG. 5A illustrates the approximate proportions of the ring with a =4.5, b=2.3, c=3.9, d=2.0.

Figure 6:
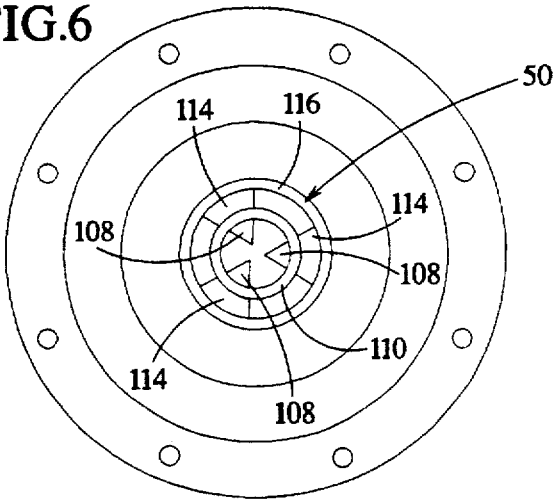
FIG. 6 is a bottom view of a fixed cover shown in FIG. 2.

FIG. 6 shows the distributor 50 having open triangular areas 108 surrounded by an annular dividing wall 110. The open triangular areas 108 are open into the conduit 54 to serve the upper wash arms. Outside the annular dividing wall 110 are annular openings 114 surrounded by an annular surrounding wall 116. The annular openings 114 serve the lower wash arms and flush arms via the distribution pipe 52.

Figure 7:
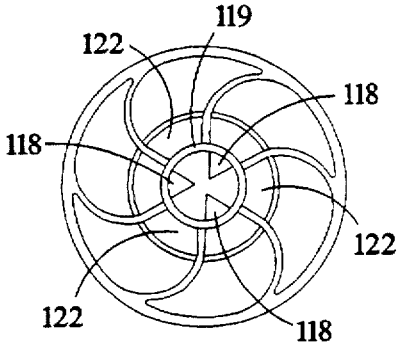
FIG. 7 is a bottom view of a movable inner cover to be used in conjunction with the fixed cover of FIG. 6.

FIG. 7 shows the rotatable cover 100 which has triangular openings 118 surrounded by an annular dividing wall 119. Outside the annular dividing wall are offset annular openings 122. Because the annular opening 122 are offset in the rotating cover 100, in one position such as shown in FIG. 2, the annular openings 122 are in open registry with the annular openings 114 which allows water $W_2$ to flow to the lower wash arms 28 and flush arms 30. When the cover 100 is rotated approximately 60° by the device M, the annular openings 122 come out of registry with the annular openings 114, and the triangular openings 118 register with the triangular openings 108 to allow flow through the conduit 54 to the upper wash arms. If the cover 100 is only rotated 30°, some degree of registry will be attained with the annular openings 114, 122 and the triangular openings 108, 118 so that some water will flow to all arms.

Figure 8:
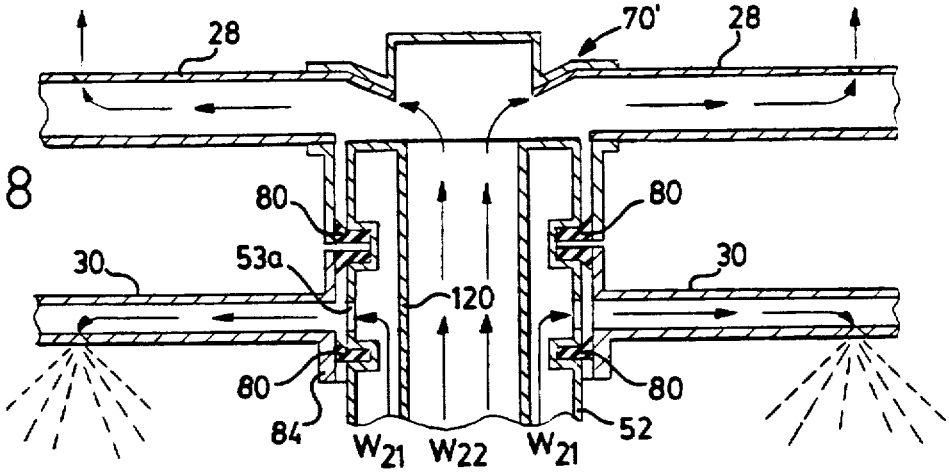
FIG. 8 is a schematic sectional view of an alternate embodiment of the present invention.

FIG. 8 illustrates a simple schematic embodiment of the invention wherein the lower wash arms 28 and the flush arms 30 are divorced for fluid flow, the flush arms 30 receiving water $W_{21}$ while the lower wash arms receive water $W_{22}$. The arms are separated by an inside conduit 120. A distributor (not shown) such as the distributor 50 and a rotatably cover such as the cover 100 can be used to selectively deliver water through the conduits 52 or 120 or to always deliver water $W_{21}$ through the conduit 52 while selectively opening and closing conduit 120. This could be used for example in a zone washing system.

Although the present invention has been described with reference to a specific embodiment, those of skill in the art will recognize that changes may be made thereto without departing from the scope and spirit of the invention as set forth in the appended claims.

The embodiments of the invention in which an exclusive property or privilege is claimed are defined as follows:

1. A dishwasher comprising:

a dish compartment having a means for holding dishes therein, said compartment having a floor located below said means for holding;

a soil separator located on said floor having a screen on a top thereof and an inlet for receiving wash water from said dish compartment for recycling, said separator having a water pump for pumping wash water through said screen to remove soil from said wash water;

a plurality of flush arms mounted for rotation above said screen, each flush arm having a flush water conduit therein with flush apertures directed generally downwardly for spraying water against an outside of said screen, said flush arm water conduit flow connected to said water pump; and a plurality of rotating wash arms each mounted above said flush arms and having a wash water conduit with upwardly directed wash apertures for spraying dishes held on said means for holding.

2. The dishwasher according to claim 1, further comprising a surrounding sleeve, wherein said separator comprises a top mounted distributor pipe, and said flush arms are each connected to said surrounding sleeve which surrounds said distributor pipe, said distributor pipe flow connected to said water pump, and said distributor pipe having at least one flow aperture through a sidewall of said distributor pipe to flow connect said distributor pipe to said flush arms; and a top seal ring surrounding said distributor pipe and arranged between said surrounding sleeve and said distributor pipe above the flow aperture; and a bottom seal ring surrounding said distributor pipe and arranged between said surrounding sleeve and said distributor pipe below the flow aperture.

3. The dishwasher according to claim 2, wherein said distributor pipe extends above said surrounding sleeve; and comprising a cylindrical hub surrounding said distributor pipe above said surrounding sleeve, and said wash water arms are connected to said hub, said distributor pipe having a flow opening for passing water from said distributor pipe into said hub, said hub having arm openings to flow connect said hub into said water wash arms; and a wash arm sealing ring arranged between an inside of said hub and an outside of said distributor pipe.

4. The dishwasher according to claim 3, wherein said distributor pipe has plural recesses formed on an outside surface thereof for receiving said top, bottom, and wash arm sealing rings.

5. The dishwasher according to claim 2, wherein at least one of said top and bottom sealing rings provides an inclined surface facing a water pressure side of said one sealing ring, and said one sealing ring has a section removed to allow for expansion of said one sealing ring under water pressure, said inclined surface arranged to open said one sealing ring against said surrounding sleeve under water pressure.

6. The dishwasher according to claim 1, further comprising a means for separating flow of water from said flush arms and said wash arms, and means for controlling water flow into the wash arms.

7. The dishwasher according to claim 1, wherein said flush apertures are arranged to impart a rotary force to said flush arms.

8. A water distributor for a soil separator of a recycle water dishwasher having an annular upwardly facing screen and a water pump for passing wash water through the screen and said water pump also pumping water for spraying dishes in the dishwasher, comprising:

a vertical pipe mounted above said pump and surrounded by said annular screen, said pipe receiving water from said pump;

at least one flush arm mounted for rotation on a sleeve surrounding the vertical pipe, said flush arm having downwardly directed apertures for spraying onto said annular screen, said flush arm hollow to receive water therein and said flush arm flow connected through said surrounding sleeve to said vertical pipe; and at least one wash arm mounted for rotation on a cylinder surrounding the vertical pipe and being hollow with discharge apertures directed toward said dishes in said dishwasher, said wash arm flow connected through said cylinder to said vertical pipe.

9. The water distributor according to claim 8, wherein said surrounding sleeve is sealed to said vertical pipe by at least one sealing ring having in cross section, a tabular portion interfit into a recess in the vertical pipe and a triangular portion pressed to said surrounding sleeve with an inclined surface facing water pressure.

10. The water distributor according to claim 9, wherein said sealing ring has a gap for allowing the ring to expand.

11. A dishwasher, comprising:

a dish compartment for holding dishes;

a soil separator having a screen arranged facing into the dish compartment, a recycle inlet for receiving water from the dishwasher, a pump for passing water from said dishwasher through said screen and trapping soil on the screen;

a flush arm mounted above the screen for rotation and having downwardly directed apertures for spraying water onto the screen;

a means for rotating the flush arm during spraying of the screen;

a wash arm mounted above the flush arm and arranged for rotation, said wash arm having upwardly directed apertures for spraying the dishes; and a means for rotating the wash arm.

12. The dishwasher according to claim 11, wherein said means for rotating the flush arm comprises tangentially arranged apertures.

13. The dishwasher according to claim 11, comprising a guard arranged over said screen and attached to said flush arm.

14. A method of operating a soil separator and wash arm of a dishwasher comprising the steps of:

providing a soil separator with an annular screen for screening recycled wash water;

recycling wash water through said annular screen trapping soil beneath said annular screen;

providing a flush arm above said annular screen, the flush arm having downwardly directed spray apertures;

rotating said flush arm above said annular screen;

spraying water through said flush spray apertures to flush said screen;

providing a separate wash water arm having upwardly directed wash spray apertures for spraying dishes; and spraying said dishes with water from said separate wash water arm.

15. The method of claim 14, comprising the further step of rotating the separate wash water arm.

16. The method of claim 15, wherein said steps of rotating said flush arm and rotating said separate wash water arm are further defined in that the flush arm and separate wash water arm are rotated in different directions.

17. The method of claim 15, wherein said steps of rotating said flush arm and rotating said separate wash water arm are further defined in that the flush arm and separate wash water arm are rotated at different speeds.

18. The method of claim 14, wherein said step of spraying said dishes with water from said wash water arm is further defined in that the wash water arm is operated intermittently while the step of spraying water through said flush spray apertures and rotating said flush arms are operated continuously.

* * * * *